US007827745B2

(12) United States Patent
Franceschet

(10) Patent No.: US 7,827,745 B2
(45) Date of Patent: Nov. 9, 2010

(54) PANEL PARTICULARLY FOR PROVIDING EXPLOSION-RESISTANT CURTAIN WALLS

(75) Inventor: Alberto Franceschet, Pieve Di Soligo (IT)

(73) Assignee: Permasteelisa S.p.A., Vittorio Veneto (TV)

( * ) Notice: Subject to any disclaimer, the term of this patent is extended or adjusted under 35 U.S.C. 154(b) by 830 days.

(21) Appl. No.: 11/655,988

(22) Filed: Jan. 22, 2007

(65) Prior Publication Data

US 2007/0193142 A1 Aug. 23, 2007

(30) Foreign Application Priority Data

Feb. 3, 2006 (IT) ..... TV06A0011

(51) Int. Cl.
*E04H 1/00* (2006.01)
*E04H 1/06* (2006.01)
*E04H 9/00* (2006.01)

(52) U.S. Cl. ..... 52/235; 52/236.3; 52/483.1; 52/272

(58) Field of Classification Search ..... 52/235, 52/236.3, 272, 474, 483.1, 582.1
See application file for complete search history.

(56) References Cited

U.S. PATENT DOCUMENTS 3,038,568 A * 6/1962 Morgan ..... 52/235
3,415,024 A * 12/1968 Kotlarz ..... 52/220.2
3,465,996 A * 9/1969 Wedel ..... 248/287.1
3,940,897 A * 3/1976 Stoakes ..... 52/395
4,506,484 A * 3/1985 Bartlett et al. ..... 52/476
4,662,136 A * 5/1987 Tanikawa et al. ..... 52/235
4,672,784 A * 6/1987 Pohlar ..... 52/235
4,707,959 A * 11/1987 Stoakes ..... 52/235
4,947,593 A * 8/1990 Kuo ..... 52/105
4,977,717 A * 12/1990 Niwata ..... 52/235
5,056,577 A * 10/1991 DeLong et al. ..... 160/135
5,067,293 A * 11/1991 Reynolds ..... 52/235
5,107,647 A * 4/1992 Danielewicz ..... 52/235
5,363,625 A * 11/1994 Philippi ..... 52/653.2
6,226,940 B1 * 5/2001 Biebuyck et al. ..... 52/235
6,267,525 B1 * 7/2001 Wu ..... 403/49
6,295,764 B1 * 10/2001 Berridge et al. ..... 52/36.5
6,301,847 B1 * 10/2001 Beck et al. ..... 52/239
6,389,773 B1 * 5/2002 Reuter et al. ..... 52/582.2
2004/0031220 A1 * 2/2004 Hocker et al. ..... 52/235
2005/0284046 A1 * 12/2005 Neal ..... 52/204.5
2005/0284053 A1 * 12/2005 Grunewald et al. ..... 52/235
2007/0022682 A1 * 2/2007 Morgenegg et al. ..... 52/235

FOREIGN PATENT DOCUMENTS

DE 24 04 899 A1 8/1975

* cited by examiner

*Primary Examiner*—Brian E Glessner
*Assistant Examiner*—Jason Holloway
(74) *Attorney, Agent, or Firm*—Modiano & Associati; Albert Josif; Daniel J. O'Byrne

(57) ABSTRACT

A panel for providing explosion-resistant curtain walls comprising at least one glass pane suitable to form a glazing unit, and associated with a supporting frame constituted by at least two uprights connected, at their upper and lower ends, by at least two cross-members. The panel comprises an interconnection device for strengthening and interconnecting the uprights and the cross-members, a guiding device for strengthening and guiding in position two contiguous uprights of two panels arranged one above the other, and a limiting device for limiting mutual rotation of two contiguous uprights of two panels arranged side by side.

18 Claims, 11 Drawing Sheets

PANEL PARTICULARLY FOR PROVIDING EXPLOSION-RESISTANT CURTAIN WALLS

The present invention relates to a panel particularly for providing explosion-resistant curtain walls.

BACKGROUND OF THE INVENTION

Currently it is customary to erect buildings whose outer glazed walls are constituted partially or entirely by a plurality of panels which comprise one or more glass panes, which are approximately flat and mutually parallel and are supported by appropriately provided frames which are typically metallic and can be fixed to the supporting structure of the building.

These frames generally comprise two metallic uprights, which are approximately mutually parallel and are connected, at their ends, by two cross-members; the two uprights and the two cross-members further comprise respectively male-female interlocking means for mating, during use, respectively with the uprights and cross-members of the contiguous panels.

In particular, it is known to provide panels which are suitable to be installed in buildings which are particularly exposed to the risk of explosions, such as for example buildings for military use, banks, and centers of political activity.

Current procedures for the design of known types of such panel entail sizing said panels so that they withstand, without undergoing permanent deformation, a static load which is equivalent to the stresses that occur during an explosion; this entails great thicknesses, and therefore weights, for the frames and the glass panes that constitute the panels and therefore entails high costs for their production, transport and installation.

Further, the great weight of these known types of panel entails the additional drawback of applying intense mechanical stresses to the load-bearing structure of the building to which they are applied, thus requiring, in some cases, the strengthening of said load-bearing structure, with a consequent further cost increase.

Further, since said known types of panel react to the stresses applied by an explosion by deforming elastically, they transfer a substantial fraction of the energy of said explosion to the load-bearing structure of the building, which therefore can be damaged.

SUMMARY OF THE INVENTION

The aim of the present invention is to solve the above mentioned problems, eliminating the drawbacks of the cited background art, by providing a panel for providing a curtain wall which is capable of withstanding explosive events and has a reduced weight, so as to reduce the stresses applied to the load-bearing structure of the building to which said curtain wall is applied.

Within this aim, an object of the invention is to provide a panel which can be transported and installed easily in a building.

Another object of the invention is to avoid transmitting, during an explosion occurring in its vicinity, intense mechanical stresses to the load-bearing structure of a building with which said invention is associated, thus limiting the damage to said building.

Another object is to provide a panel which protects the internal environment of a building to which said panel is applied against an explosion which occurs outside said building.

Another object is to provide a panel which has lower production, transport and installation costs with respect to the background art.

This aim and these and other objects, which will become better apparent hereinafter, are achieved by a panel, particularly for providing explosion-resistant curtain walls, which comprises one or more glass panes, so as to form a glazing unit, which are associated with a supporting frame constituted by at least two uprights which are connected, at their upper and lower ends, by at least two cross-members, characterized in that it comprises first means for strengthening and interconnecting said uprights and said cross-members, second means for strengthening and guiding the mutual position of two contiguous uprights of two panels arranged one above the other being associated with said uprights, said panel being provided with third means for limiting the mutual rotation of two contiguous uprights of two panels arranged side by side.

BRIEF DESCRIPTION OF THE DRAWINGS

Further characteristics and advantages of the invention will become better apparent from the following detailed description of a particular but not exclusive embodiment thereof, illustrated by way of non-limiting example in the accompanying drawings, wherein.

DESCRIPTION OF THE PREFERRED EMBODIMENTS

Figure 1:
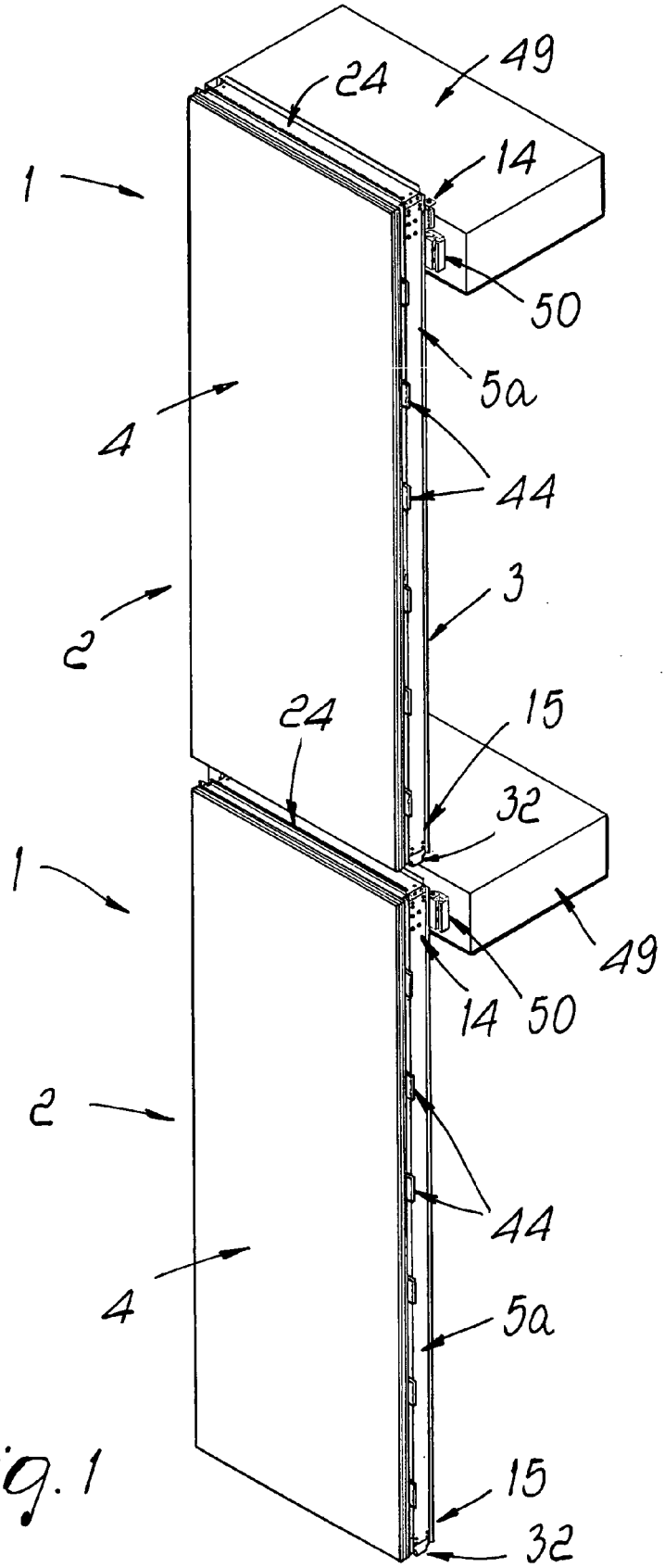
FIGS. 1 and 2 are perspective views of two panels according to the invention, respectively before and after their application to the load-bearing structure of a building.
Figure 2:
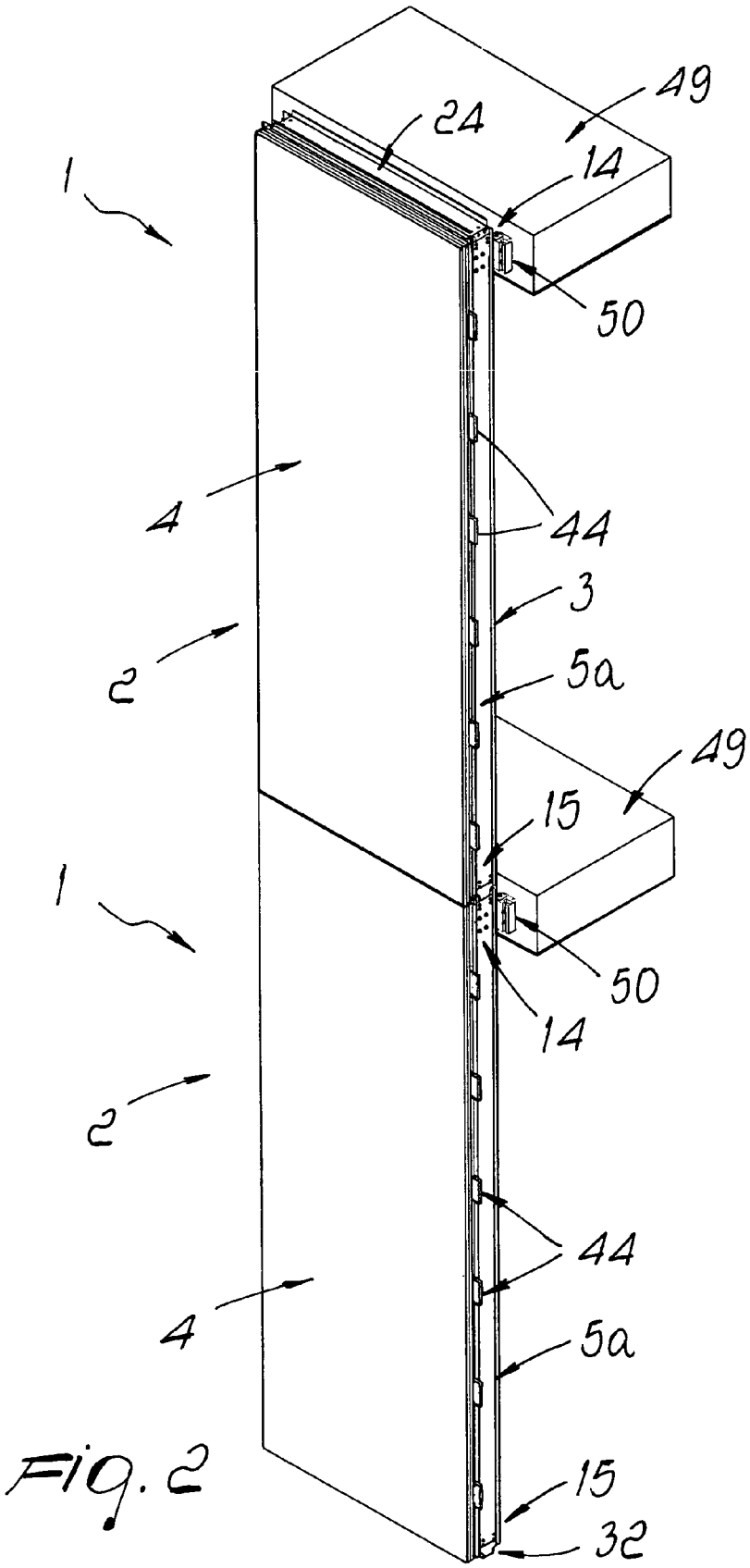
Figure 3:
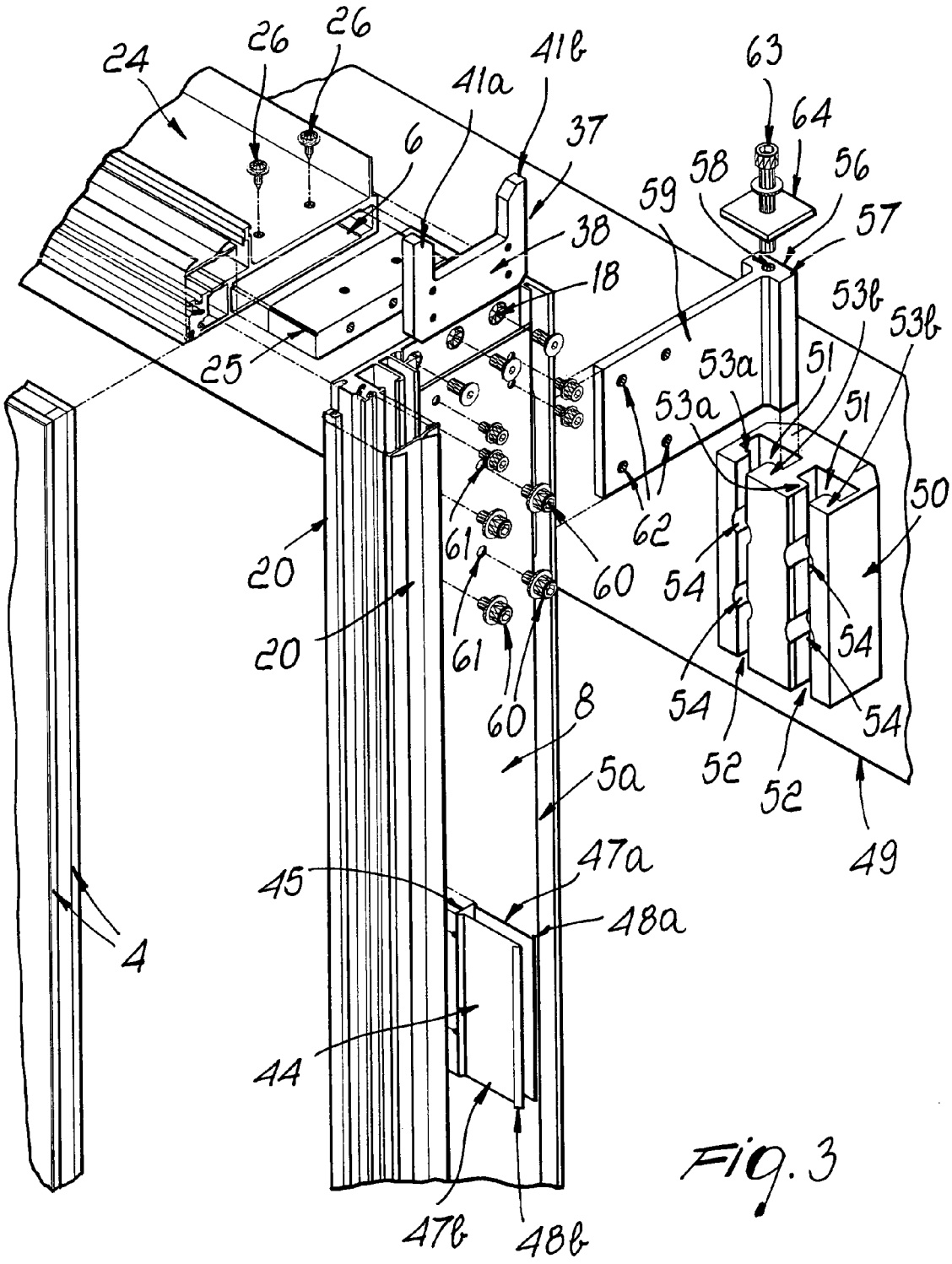
FIG. 3 is an exploded perspective view of a detail of a panel according to the invention.
Figure 4:
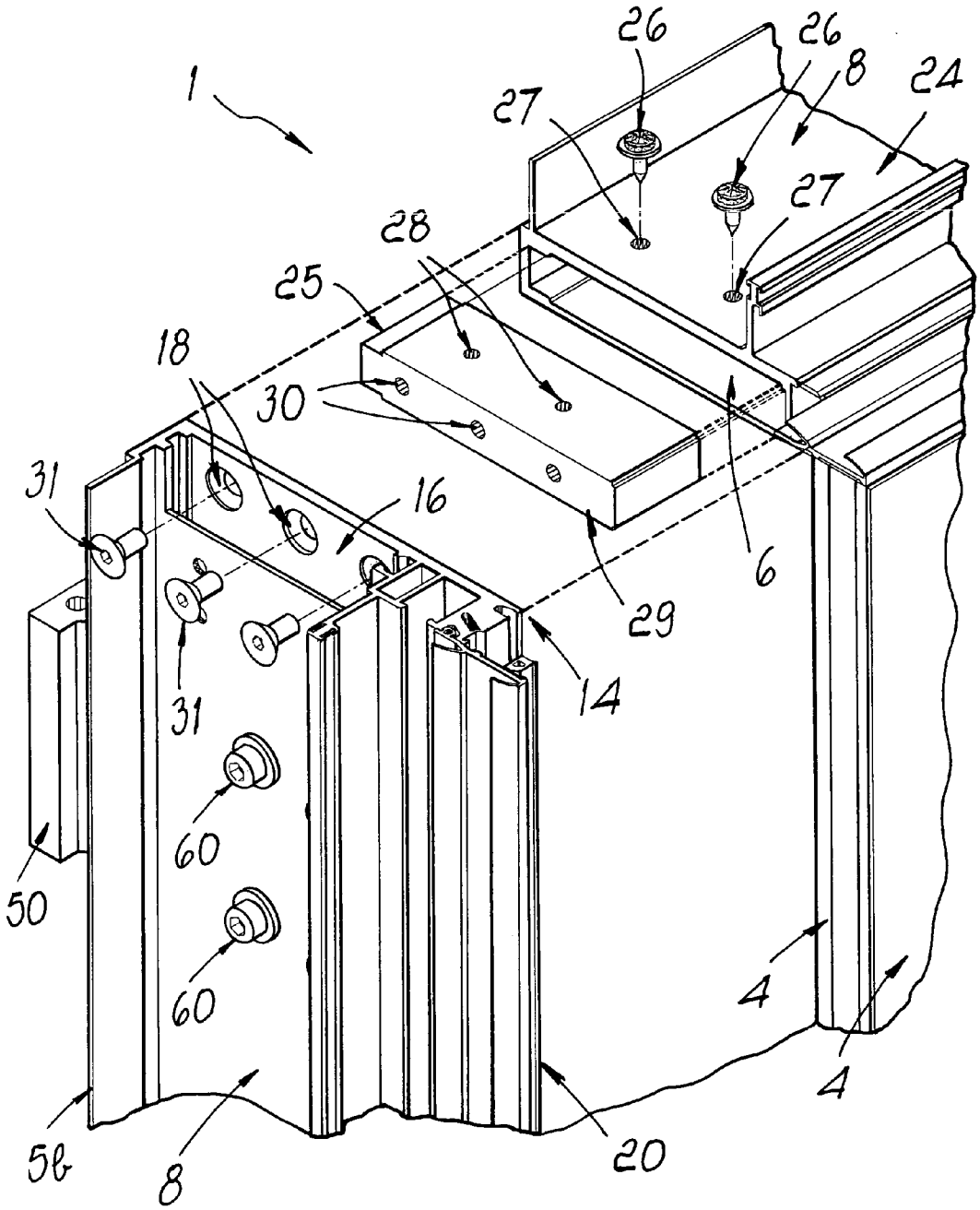
FIG. 4 is an exploded perspective view of a detail of the first strengthening and interconnection means of the panel of FIG. 3.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to the figures, the reference numeral 1 designates a panel particularly for providing explosion-resistant curtain walls 2, which is associated with a frame 3 for supporting one or more glass panes 4 so as to form a glazing unit.

The frame 3 is constituted by two uprights, designated respectively by the reference numerals 5*a* and 5*b*, which are preferably metallic and have an approximately rectangular transverse cross-section.

First seats 6 are provided axially with respect to the uprights 5*a* and 5*b*, have an approximately rectangular plan shape, and affect or extend over the uprights 5*a* and 5*b* along their entire length.

The uprights 5*a* and 5*b* further cooperate with means for the male-female mating with uprights 5*b* and 5*a* of additional contiguous panels 1.

Figure 8:
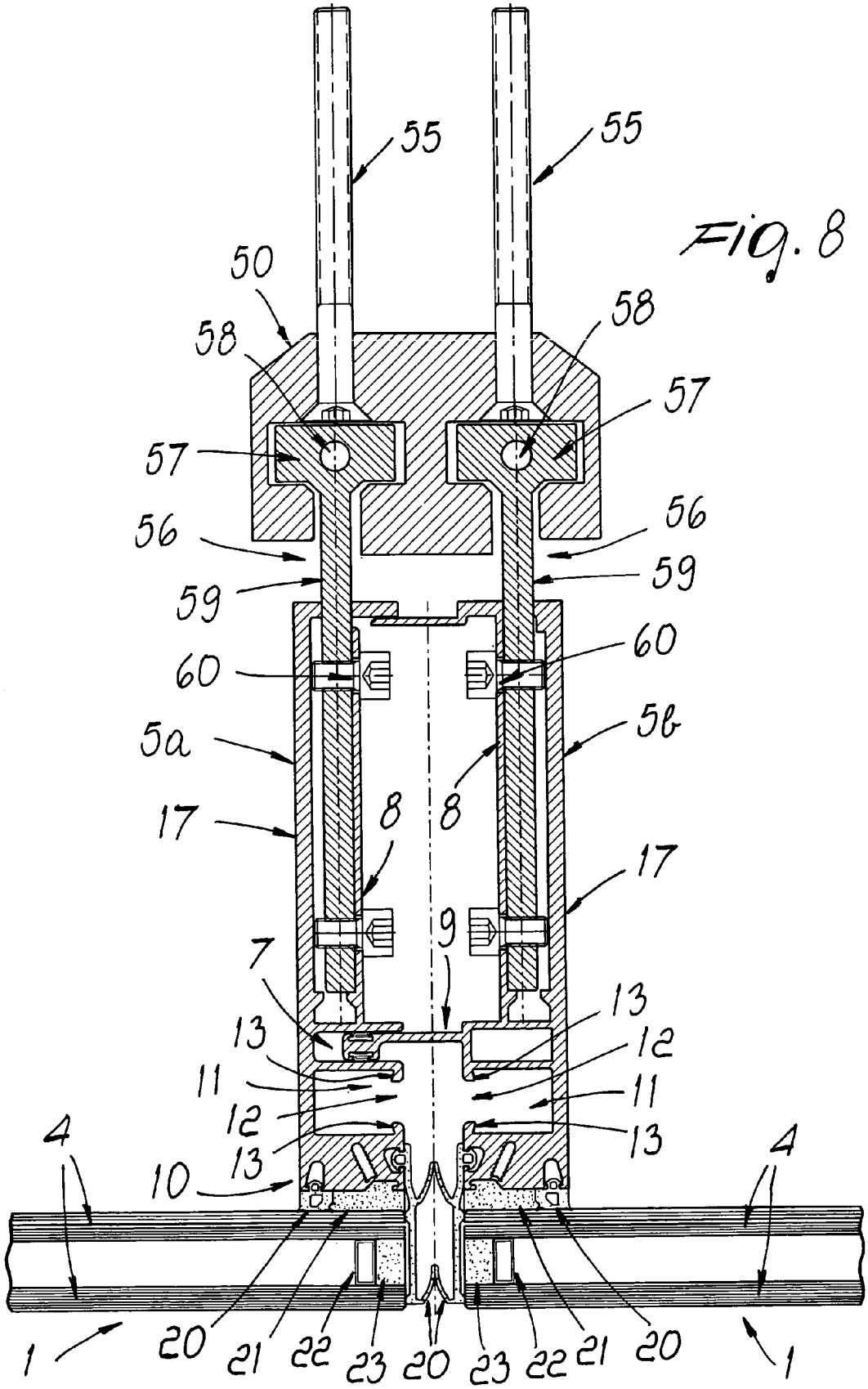
FIGS. 8 and 9 are two sectional views, taken along two different and mutually parallel transverse planes, of a detail of two contiguous panels.
Figure 9:
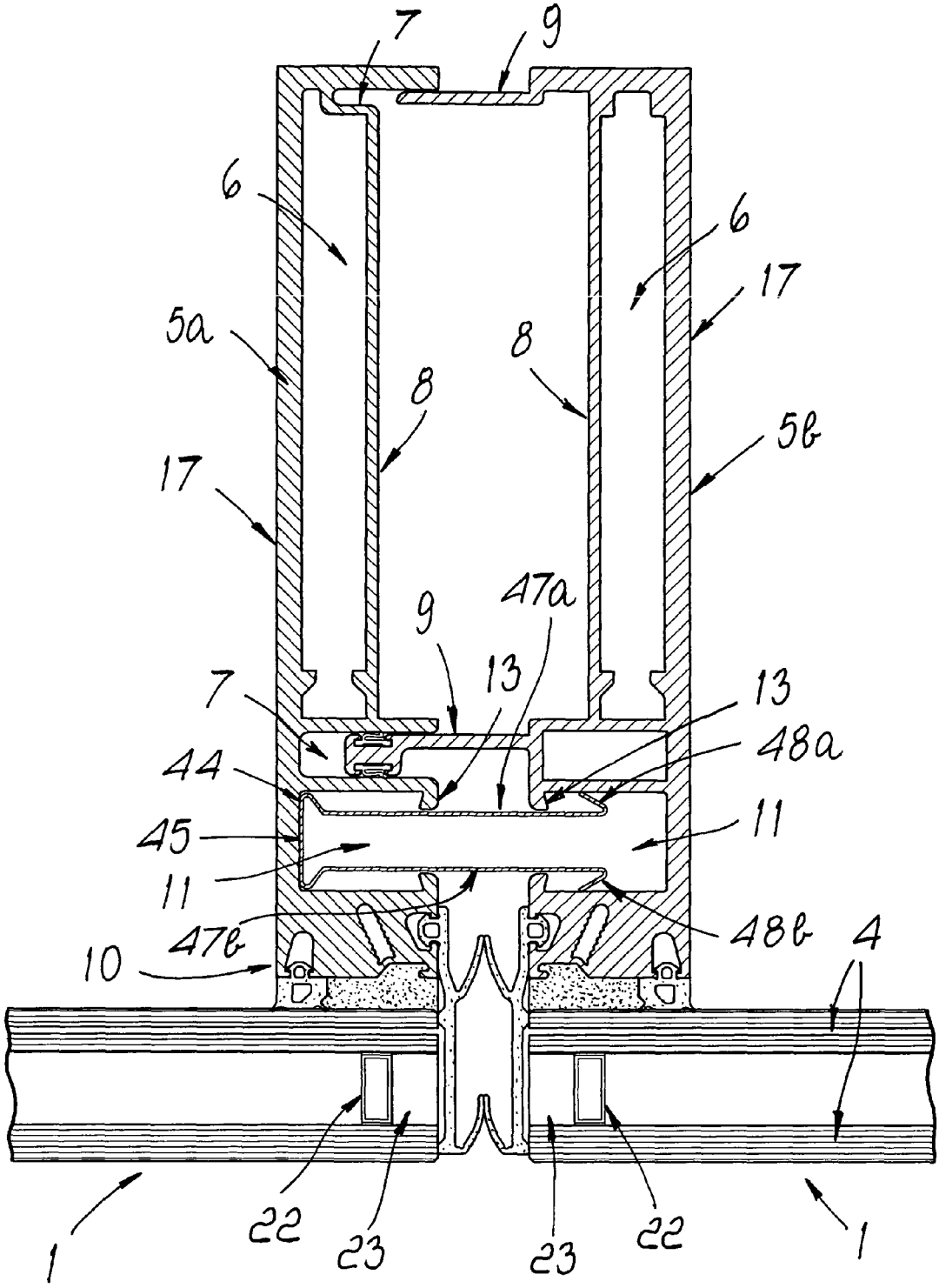
Figure 10:
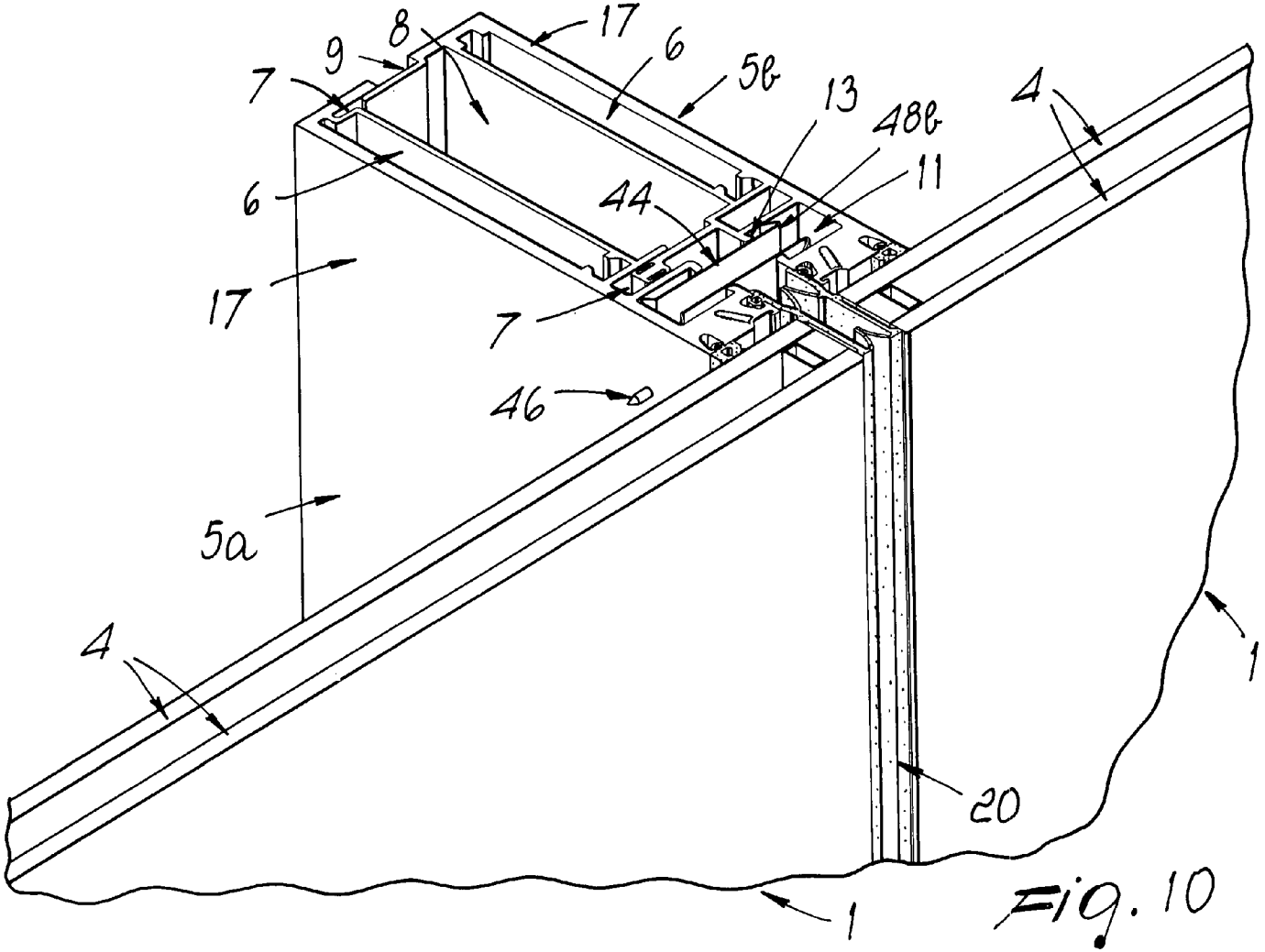
FIG. 10 is a perspective view of a detail of two contiguous panels in the inactive condition.
Figure 11:
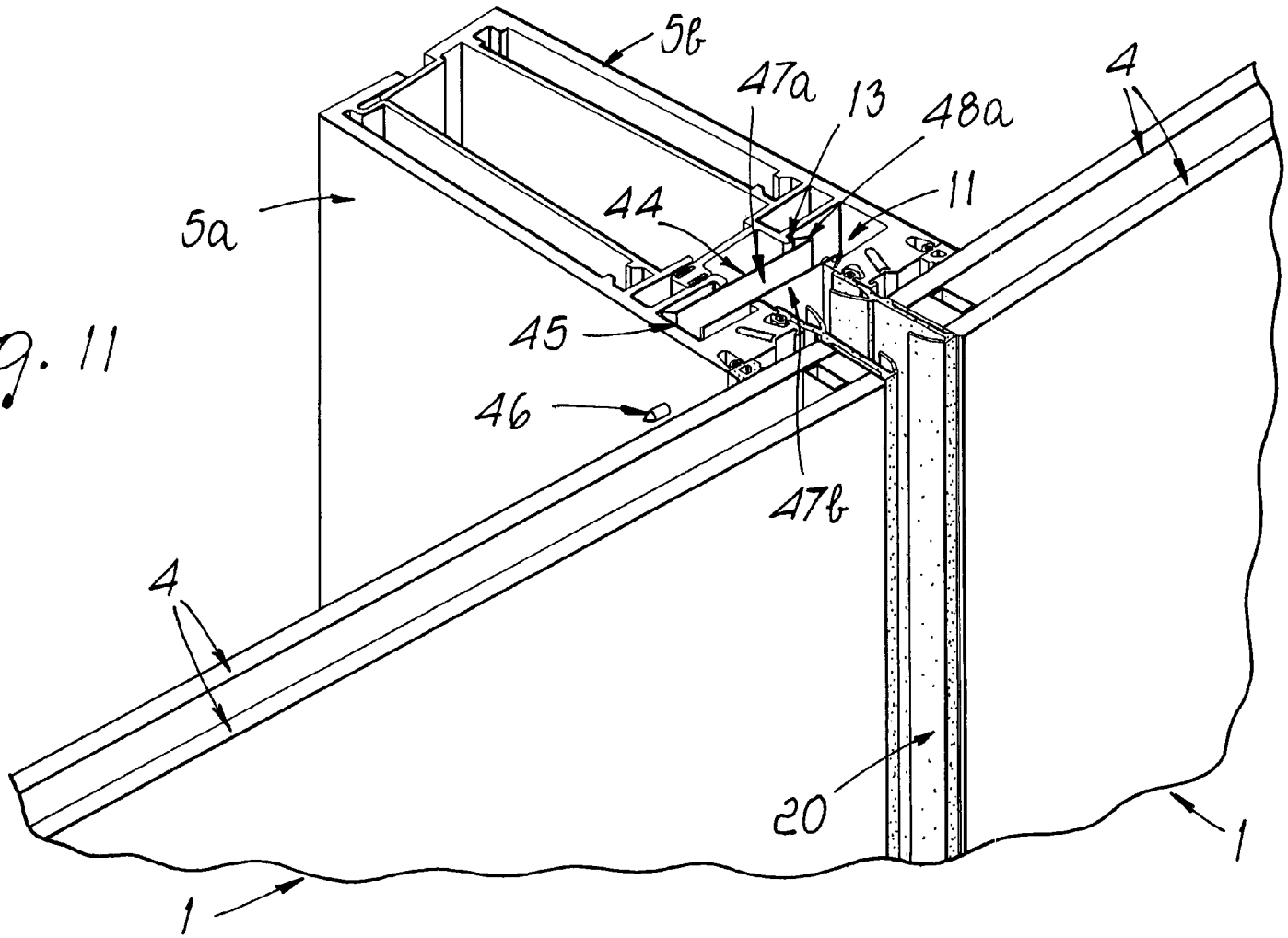
FIG. 11 is a view, similar to FIG. 10, of a detail of two contiguous panels in a mutual rotational condition.

Advantageously, said male-female mating means comprise one or more grooves 7, which are formed transversely and externally with respect to a first side wall 8 of one of the two uprights 5*a* and 5*b* and in which tabs 9 are inserted which protrude approximately at right angles from the first side wall 8 of the other upright 5*b* or 5*a*, as shown in FIGS. 8 and 9.

Said one or more grooves 7 affect or extend over the entire length of the uprights 5*a* and 5*b*.

Second seats 11 are formed on said uprights, proximate to one of their lateral ends 10 which during use is directed toward the glass panes 4 and adjacent to said one or more grooves 7; said seats affect or extend axially over the entire length of the uprights 5*a* and 5*b* and advantageously have an approximately T-shaped transverse cross-section, so as to form a first access port 12 and two first abutments 13 which affect or extend over the second seats 11 along their entire length.

The first side wall 8 is shorter than the uprights 5*a* and 5*b*, so as to form first openings 16 proximate to the upper end 14 and lower end 15 of the uprights 5*a* and 5*b*.

Advantageously, the uprights 5*a* and 5*b* have a second side wall 17, which is approximately parallel to the first side wall 8 and in which first holes 18 are provided, at the first opening 16, and are arranged advantageously so that they are approximately mutually aligned along an axis which lies transversely to the second side wall 17.

Second holes 19 are provided advantageously in the first side wall 8, in a region which is adjacent to the first openings 16, and are arranged advantageously but not necessarily approximately at the corners of a rectangle.

Proximate to the lateral ends 10 of the uprights 5*a* and 5*b* there are suitable means of a known type for connection and sealing to the glass panes 4, which comprise for example appropriately provided gaskets 20 and one or more first layers 21 of structural sealant.

In the exemplary embodiments shown in the accompanying figures, there are two glass panes 4, which are arranged so as to face each other and are kept spaced by an appropriately provided spacer channel 22 and are mutually coupled by means of a second layer 23 of structural sealant; advantageously, the innermost glass pane 4 is reinforced with one or more sheets of plastic material.

The uprights 5*a* and 5*b* are mutually connected, respectively at their upper ends 14 and at their lower ends 15, by at least two cross-members 24, which advantageously have a transverse cross-section which is substantially similar to the two uprights 5*a* and 5*b* respectively; the cross-members 24, therefore, also comprise first seats 6, which are similar to the seats of the uprights 5*a* and 5*b*, a first side wall 8, a second side wall 17, and means for coupling of the male-female type which are similar to the ones described in relation to the uprights 5*a* and 5*b*.

First, interconnection means for strengthening and interconnecting the uprights 5*a* and 5*b* and the cross-members 24 are further provided which comprise advantageously at least one block 25, which is approximately shaped like a parallelepiped and is substantially shaped complementarily, in plan view, to one of the first seats 6 formed in the cross-members 24, so that it can be positioned, during use, partially inside one of said seats.

Advantageously, the block 25 can be coupled rigidly to the respective cross-member 24 by way of appropriately provided first screws 26, which pass through third holes 27 formed in the first side wall 8 and can be rotatably associated with fourth complementarily threaded holes 28 formed in the upper surface of the block 25.

Fifth threaded holes 30 are formed at the first holes 18 provided in the uprights 5*a* and 5*b*, on a front surface 29 of the block 25 which, during use, is directed toward the outside of the first seat 6; said holes are suitable for fixing appropriately provided second screws 31 which fix the block 25, and therefore the cross-member 24 rigidly coupled thereto, to the upright 5*a* or 5*b*.

Second, guiding means for strengthening and guiding the mutual position of two contiguous uprights 5*a* and 5*b* are further associated with the uprights 5*a* and 5*b*, and two panels 1 arranged one above the other are associated therewith.

Figure 5:
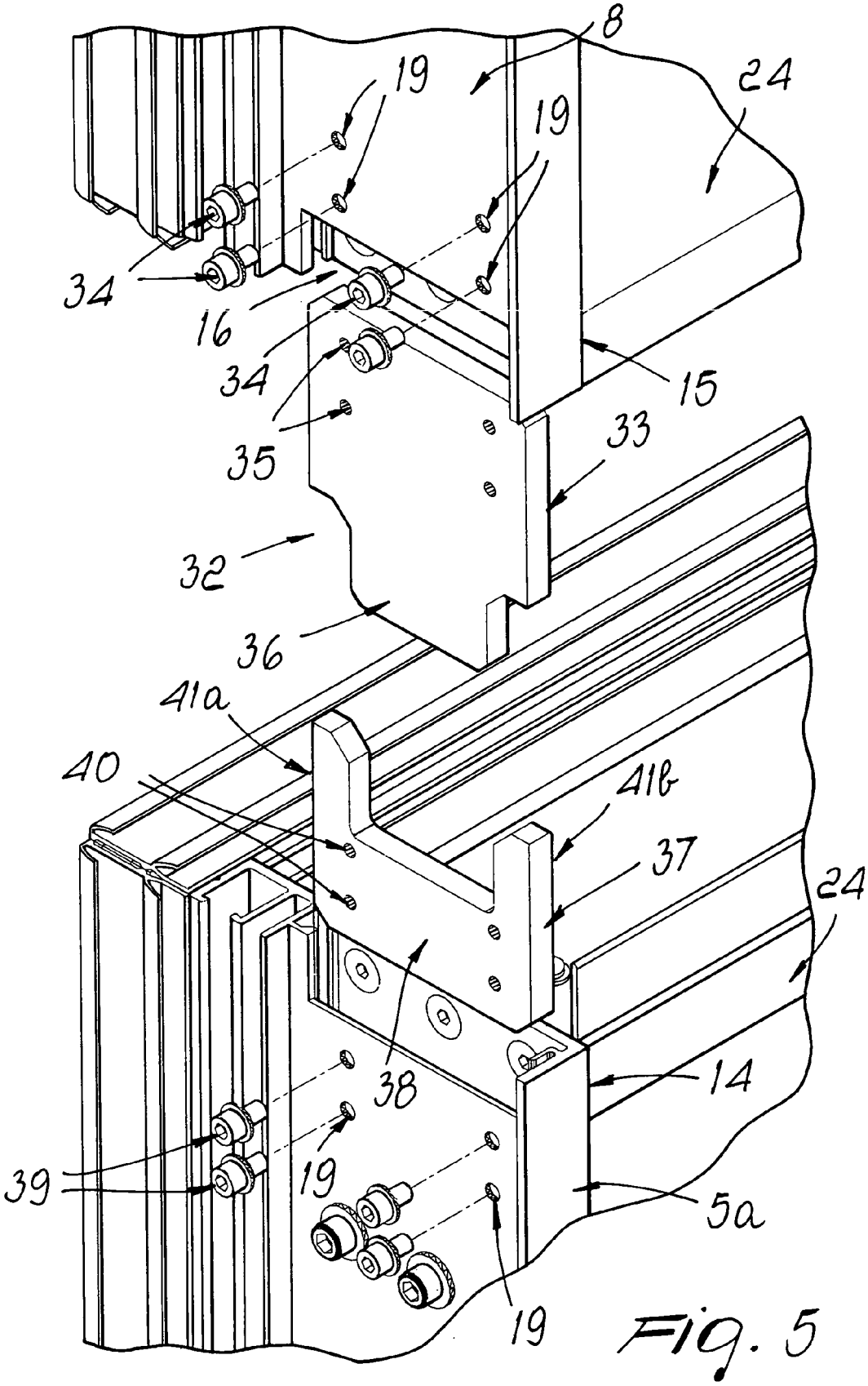
FIG. 5 is an exploded perspective view of a detail of the second strengthening and guiding means of the panel of FIG. 3.
Figure 6:
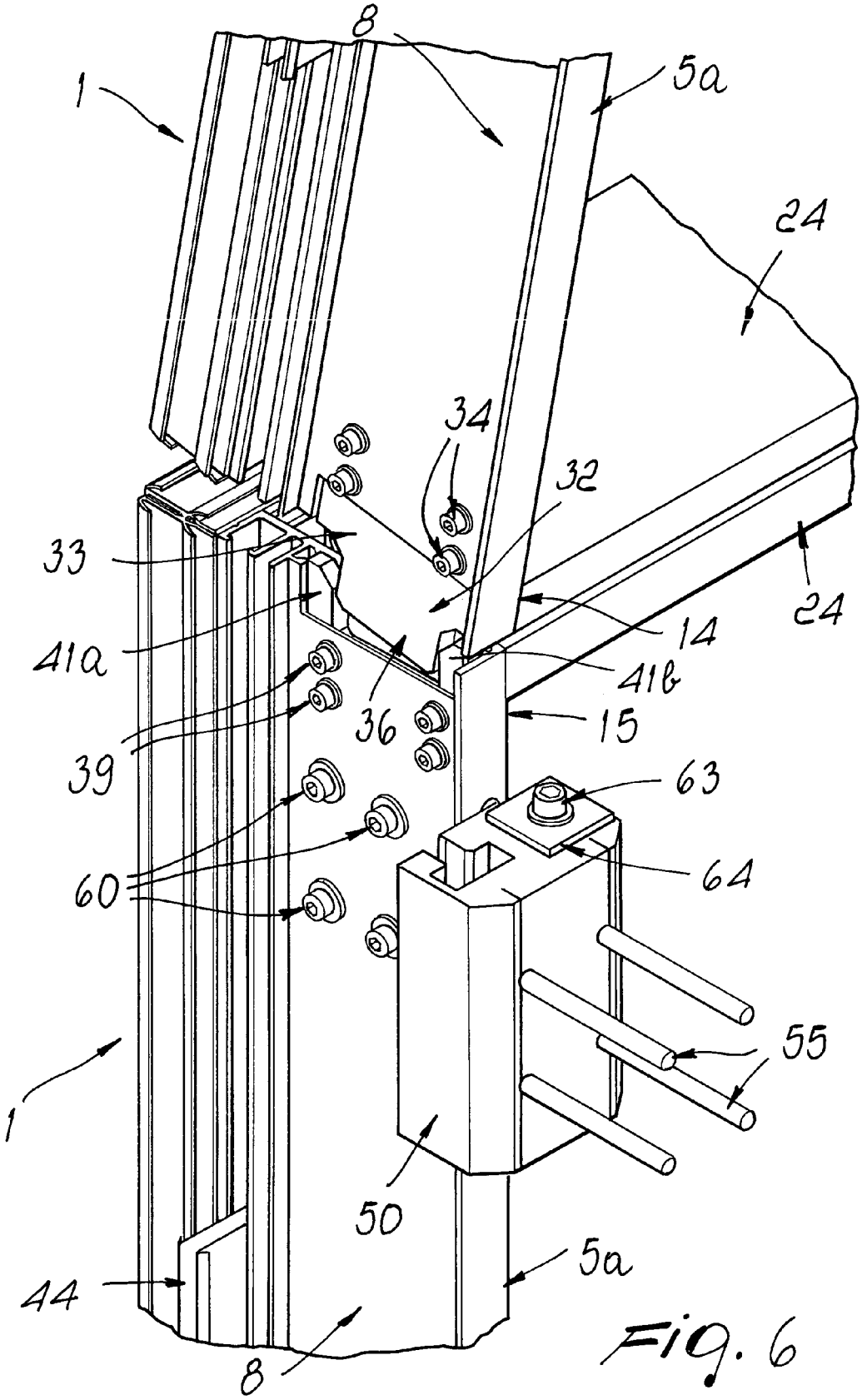
FIG. 6 is a perspective view of a detail of the second means of FIG. 5 in a different operating condition.

As shown in FIGS. 5 and 6, said second means comprise a male element 32, which can be associated with the lower end 15 of the uprights 5*a* and 5*b* and is constituted by a plug which has an approximately T-shaped plan configuration, so as to form a first head 33, which has an approximately rectangular plan shape and has an approximately rectangular transverse cross-section and dimensions which allow it to be inserted partially within the first seat 6 of the uprights 5*a* and 5*b*.

The first head 33 can be rigidly fixed, during use, to the respective upright 5*a* and 5*b* by way of appropriately provided third screws 34, which are inserted in the second holes 19 provided proximate to the lower end 15 of the upright 5*a* and 5*b* and can be fixed in appropriately provided sixth complementarily threaded holes 35 formed in the first head 33.

A first stem 36 protrudes from the first head 33 of the male element 32, on the opposite side with respect to the respective upright 5*a* and 5*b*; said stem has an approximately rectangular plan shape and beveled edges, and protrudes, during use, axially and externally with respect to the upright 5*a* and 5*b* with which the male element 32 is associated.

Said second guiding means comprise a female element 37, which can be associated with the upper end 14 of the uprights 5*a* and 5*b* at the first seat 6 and is constituted by a plug which has an approximately U-shaped plan configuration so as to form a first base 38, which has an approximately rectangular plan shape, an approximately rectangular transverse cross-section, and dimensions which allow to accommodate it, during use, in the first seat 6 of an upright 5*a* and 5*b*.

The first base 38 can be fixed to the respective upright 5*a* and 5*b* by way of appropriately provided fourth screws 39, which can be inserted in the second holes 19 provided in the upright 5*a*, 5*b* proximate to the upper end 14 thereof and can be fixed in appropriately provided complementarily threaded seventh holes 40, which are provided in the first base 38 and are axially aligned with the second holes 19.

Two first arms, designated by the reference numerals 41*a* and 41*b* respectively, protrude from the base 38 approximately at right angles and on the opposite side with respect to the upright 5*a*, 5*b* and are approximately shaped like a parallelepiped with beveled edges; the mutual distance between the two first arms 41*a* and 41*b* is such that the first stem 36 of a male element 32 can be accommodated between said arms with a selected play.

Advantageously, the first arms 41*a* and 41*b* of the female element 37 are arranged, during use, approximately at the first opening 16 of the respective upright 5*a* and 5*b*.

By arranging two panels 1 one above the other, the first stems 36 of the male elements 32 which are associated with the uprights 5*a* and 5*b* of the panel 1 arranged above the other panel are arranged respectively in the interspace provided between the two first arms 41*a* and 41*b* of the female elements 37 of the panel 1 that is arranged below; the engagement of the male elements 32 with the female elements 37 improves the solidity of the connection between the two panels 1 and further allows said panels to perform even substantial mutual translational motions and/or rotations without separating.

Figure 7:
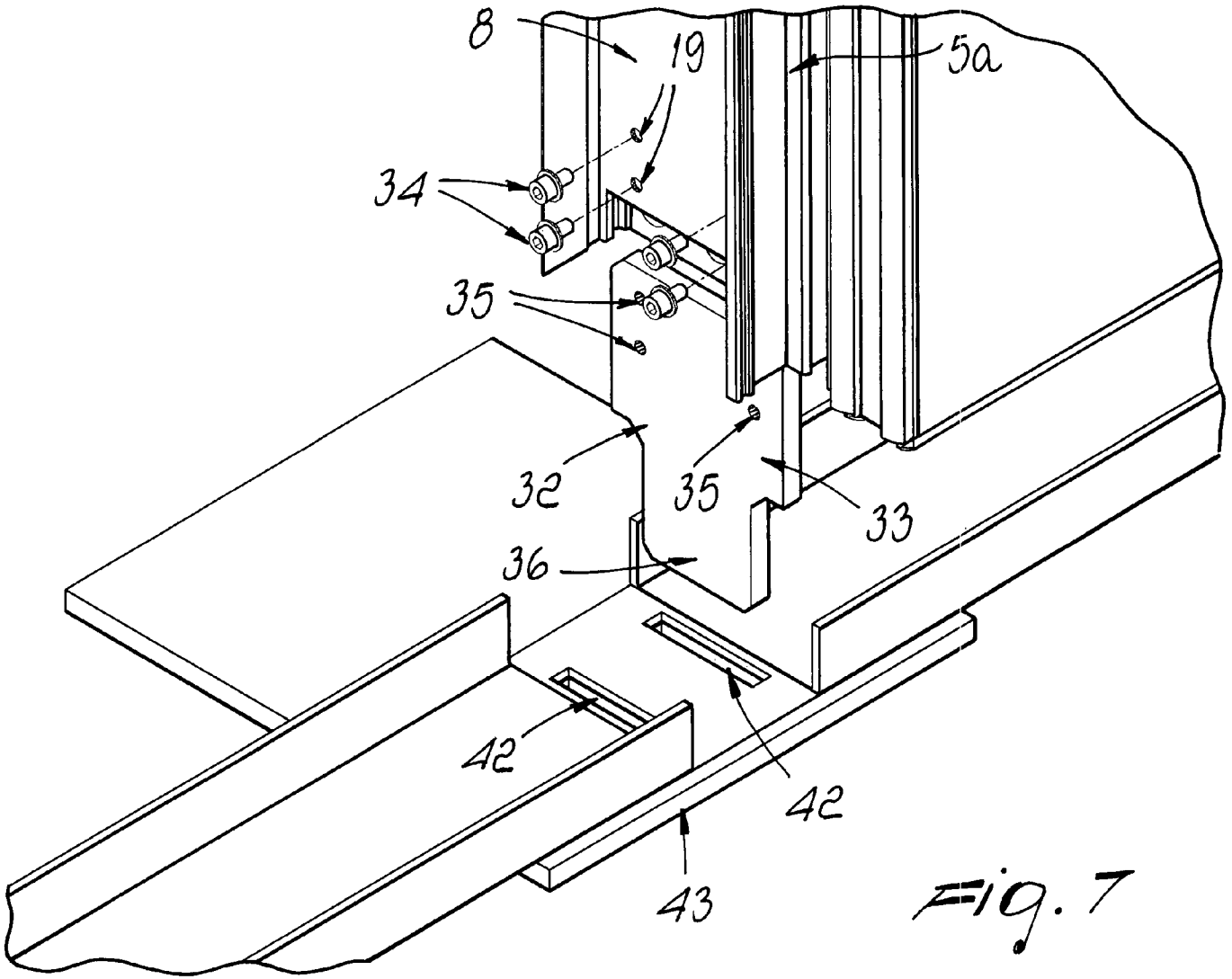
FIG. 7 is an exploded perspective view of a detail of a panel according to the invention and of a footing which can be associated below said panel.

As shown in FIG. 7, the first stem 36 of the male element 32 associated with an upright 5*a*, 5*b* can further be inserted in an appropriately provided complementarily shaped third seat 42, which has a substantially rectangular plan shape and is formed at a footing 43 which is suitable to withstand the first panel 1, arranged at the base of the building; the third seat 42 has such dimensions as to allow the first stem 36 to be inserted axially therein and perform a selected rotation with respect to its plane of arrangement without escaping from the third seat 42.

The panel 1 further comprises third limiting means for limiting the mutual rotation of two contiguous uprights 5*a* and 5*b* of two panels 1 arranged mutually side by side.

Said third limiting means are constituted advantageously by springs 44, which are constituted by a lamina which is extruded or folded so as to assume an approximately U-shaped plan configuration, in which there is a second approximately flat base 45, whose dimensions are such that it can be accommodated during use within two of said mutually facing second seats 11 of two mutually mated uprights 5*a*, 5*b*.

The second base 45 of the springs 44 is thus arranged, during use, within one of the second seats 11 adjacent to the second side wall 17 of an upright 5*a* and can be fixed to the latter by means of appropriately provided first pins 46, which can be fixed in appropriately provided eighth holes, not shown in the accompanying figures, which are provided in the second side wall 17.

Two second arms, designated respectively by the reference numerals 47*a* and 47*b*, protrude from the second base 45, are substantially flat and approximately mutually parallel, and are connected to the second base 45 by means of an inclined portion which facilitates their elastic flexing in the direction for their mutual approach.

The two second arms 47*a* and 47*b* are shorter than the sum of the distance formed by the space between two of said mutually facing second seats 11 of two mutually mated uprights 5*a* and 5*b*.

The free ends of the two second arms 47*a* and 47*b*, which are arranged approximately halfway along the depth of the respective second seat 11, are folded toward the outside of the spring 44 and toward the second base 45, forming respectively two hooks, designated by the reference numerals 48*a* and 48*b*, which are inclined and can be positioned, during use, within the second seat 11 of an adjacent upright 5*a*.

The hooks 48*a*, 48*b* can engage, during use, respectively the first abutments 13 of the respective second seat 11, so as to prevent their escape from said seat through the first access port 12 thereof.

Advantageously, the panel 1 further comprises fixing means for fixing it to the load-bearing structure 49 of a building, which comprise advantageously a support 50, which is approximately shaped like a parallelepiped and axially to which there are two fourth seats 51, which advantageously have an approximately T-shaped transverse cross-section, so as to form a second access port 52 and two second longitudinal abutments 53*a* and 53*b* which affect the fourth seats 51 along their entire length.

Advantageously, second openings 54 are provided in axial alignment with the second access ports 52, on the opposite side with respect to them, and affect the entire support 50; appropriately provided second pins 55, which can be fixed to the load-bearing structure 49 of a building, can be inserted in the second openings 54.

At least one bracket 56 is slidingly associable with each one of the fourth seats 51 and advantageously has an approximately T-shaped plan configuration so as to form a second head 57, which is substantially shaped like a parallelepiped and can be associated slidingly with the fourth seat 51; a ninth internally threaded hole 58 is provided approximately axially with respect to the second heads 57.

A second substantially plate-like stem 59 protrudes approximately at right angles from the second head 57 and can be inserted within the first seat 6 of an upright 5*a*, 5*b* through an appropriately provided third opening, which is not shown in the accompanying figures and is formed in the uprights 5*a*, 5*b* proximate to their upper end 14.

The second stem 59 can be fixed to the respective upright 5*a*, 5*b* by means of fifth screws 60, which can be associated with appropriately provided tenth holes 61 formed in the first side wall 8 of the upright 5*a*, 5*b* and can be fixed in complementarily threaded eleventh holes 62 which are provided in the second stem 59.

Advantageously, the axial position of the brackets 56 with respect to the support 50 is adjustable by way of suitable adjustment means, which are constituted advantageously by sixth screws 63, the threaded stem of which cooperates with the complementarily threaded ninth holes 58 which are associated axially with the second heads 57 and with the interposition of a perforated plate 64, which is suitable to abut against the upper transverse edge of the fourth seats 51 in order to prevent the downward escape of the second heads 57.

Operation is therefore as follows: with reference to the accompanying figures, a plurality of supports 50 are fixed to the load-bearing structure 49 of a building, rigidly coupling thereto the second pins 55 associated with the supports 50.

The brackets 56 are then fixed to the uprights 5*a* and 5*b* of the panels 1 and are then inserted in the fourth seats 51 of the supports 50.

The vertical position of the panels 1 with respect to the load-bearing structure 49 of the building can be adjusted easily by changing the degree of insertion of the sixth screws 63 in the ninth holes 58 of the second heads 57 of the brackets 56; in this manner it is in fact possible to adjust the longitudinal position of the second heads 57 with respect to the fourth seats 51 of the supports 50.

A plurality of panels 1 are thus arranged mutually side by side to constitute multiple mutually superimposed rows, so as to obtain a curtain wall.

The male elements 32 of the various panels 1 engage the contiguous female elements 37 of the underlying panels 1; the male elements 32 of the first row from the bottom are inserted in the third seats 42 of the footings 43, which in turn are fixed to the load-bearing structure 49 of the building.

The contiguous uprights 5*a* and 5*b* of the various panels 1 arranged laterally side by side are interconnected by a plurality of springs 44, which are inserted with their second base 45 and with their hooks 48*a*, 48*b* respectively in the second seats 11 of each pair of contiguous uprights 5*a* and 5*b*.

If an explosion occurs in the vicinity of said curtain wall, the shock wave generated by said explosion is transmitted to the panels 1; the uprights 5*a* and 5*b* and the cross-members 24 of the panels 1 are sized so that they can deform permanently, reaching even substantial deformations.

The outermost glass panes 4 are optionally sized so that they can break during the explosion.

The innermost glass pane also can break, but its fragments remain stuck to the one or more plastics sheets that reinforce it; said sheets are sized so that they can deform plastically without breaking, thus reducing the risk that the fragments coupled to them might damage people or objects that are inside the building.

The presence of the first means for strengthening and interconnection between the uprights 5*a* and 5*b* and the cross-members 24 reduces the risk that the intense deformations undergone by them might cause their mutual separation, which would cause the glass panes 4 that are still supported by them to fall; at least the innermost glass pane 4 therefore remains associated with the frame 3 and can be deformed but cannot break, thus protecting the interior of the building against the shock wave generated by the explosion.

Further, the engagement of the male elements 32 with the female elements 37 subjects the contiguous uprights 5*a* and 5*b* of two mutually superimposed panels 1 to great deformations and movements without mutually separating, thus ensuring the vertical continuity of the curtain wall during the explosion and accordingly protecting the interior of the building from the effects of said explosion.

Further, the presence of the springs 44 ensures that the various panels 1 arranged mutually side by side do not separate during an explosion, thus ensuring that the continuity of the curtain wall is maintained also in a horizontal direction.

The preservation of the horizontal continuity of the curtain wall is assisted also by the shape of the second head 57 of the brackets 56 and of the fourth seats 51 within which they are accommodated; the square shape of said components allows minimal rotations of the bracket 56 with respect to the respective support 50.

It has thus been found that the invention has achieved the intended aim and objects, a panel particularly for providing explosion-resistant curtain walls having been provided which, by allowing the deformation of the uprights and of the cross-members that constitute it, does not require said uprights and cross-members to have great thicknesses and therefore great weights, thus reducing the mechanical stresses applied by said panel to the load-bearing structure of the building to which it is applied.

Further, the reduced weight of the uprights and cross-members and the presence of the supports and of the respective brackets facilitate the transport and installation of the panel according to the invention.

Moreover, the presence of the second means for strengthening and guiding the mutual position of two contiguous uprights and of the third means for limiting the mutual rotation of two contiguous uprights allows to maintain, during an explosion, the vertical and horizontal continuity of the curtain wall constituted by means of the panel according to the invention, thus protecting the interior of the building against the effects of the explosion.

Further, the possibility of the uprights and cross-members to deform plastically and therefore absorb part of the energy of an explosion limits the fraction of said energy that is transferred to the load-bearing structure of the building, consequently limiting the damage thereto.

Moreover, the production costs of the invention remain low, since the invention is constituted exclusively by components which are easily available or simple to produce and assemble.

The terms "approximately" and "substantial/substantially", as used herein, are intended to mean that the feature to which they refer has the form/shape/configuration indicated but for tolerances that are known to be normal by the ones skilled in the present technical field.

The invention is of course susceptible of numerous modifications and variations, all of which are within the scope of the appended claims.

The materials used, as well as the dimensions that constitute the individual components of the invention, may of course be more pertinent according to specific requirements.

The various means for performing certain different functions need not certainly coexist only in the illustrated embodiment but can be present per se in many embodiments, including ones that are not illustrated.

The characteristics indicated as advantageous, convenient or the like may also be omitted or be replaced with equivalents.

The disclosures in Italian Patent Application No. TV2006A000011 from which this application claims priority are incorporated herein by reference.

What is claimed is:

1. A panel for providing an explosion-resistant curtain wall, comprising:

a frame (3) being constituted by at least two uprights (5*a*, 5*b*) and at least two cross-members (24), said uprights (5*a*, 5*b*) being connected, at upper (14) and lower (15) ends thereof by said cross-members (24);

at least one glass pane (4) which is connected to said supporting frame (3) so as to form a glazing unit;

first seats (6) provided, respectively, in each one of said uprights (5*a*, 5*b*) and said cross-members (24) so as to extend along the entire length thereof;

second seats (11) that are provided axially in each one of said uprights (5*a*, 5*b*), proximate to a lateral end thereof and extending along an entire length of said uprights (5*a*, 5*b*);

interconnection means (25) for strengthening and interconnecting said uprights (5*a*, 5*b*) and said cross-members (24), said interconnection means (25) comprising at least one block rigidly fixable to a respective one of said uprights (5*a*, 5*b*) and shaped so as to be positionable partially inside said first seat (6) of a respective one of said cross-members (24);

strengthening means (32, 37) for strengthening and guiding a mutual position of two said uprights (5*a*, 5*a*, 5*b*, 5*b*) that are contiguous and belong to two panels (1) arranged one above the other to form the curtain wall, said strengthening means (32, 37) being connectable with said uprights (5*a*, 5*a*, 5*b*,5*b*), wherein said strengthening means comprise: a male element (32) connectable with a said first seat (6) at a lower end (15) of one (5*a*) of the two contiguous uprights (5*a*, 5*a*, 5*b*, 5*b*) belonging to two panels (1) arranged one above the other, and a female element (37) that is connectable with a said first seat (6) at an upper end (14) of the other one (5*a*) of said contiguous uprights (5*a*, 5*a*, 5*b*, 5*b*), said male element (32) being engageable in said female element (37);

rotation limiting means (44) for limiting mutual rotation of two mateable said uprights (5*a*, 5*b*) that are contiguous and belong to two panels (1) arranged side by side to form the curtain wall, wherein said rotation limiting means (44) comprise respective springs (44), each one of which is dimensioned so as to be accommodateable within a space formed by two mutually facing said second seats (11) of two said mateable uprights (5*a*, 5*b*) of two panels (1) arranged side by side; and fixing means (50) for fixing the panel (1) to the load bearing structure (49) of a building, wherein said fixing means comprise: a support (50) provided with seats (51) thereof, at least one bracket (56) that has a head (57) which is substantially shaped like a parallelepiped and is slidingly associable with each one of said seats (51) of said support (50), and a plate-shaped stem (59) connected to said head (57), the stem being insertable within a said first seat (6) of a said upright (5*a*, 5*b*), and wherein said head (57) of the bracket (56) and said seats (51) of the support (50) are shaped so as to allow minimal rotations of the bracket (56) with respect to said support (50) that are such as to allow preservation of horizontal continuity of the panel constituted curtain wall, and said uprights (5*a*, 5*b*) and cross-members are sized so as to deform plastically to absorb energy of an explosion.

2. The panel of claim 1, wherein said first seats (6) are formed axially with respect to said uprights (5*a*, 5*b*) and said cross-members (24) and have an approximately rectangular plan shape, and wherein said at least one block (25) is approximately shaped like a parallelepiped with a plan shape that is substantially complementary to a shape of one of said first seats (6) formed axially in said cross-members (24), said at least one block being rigidly coupleable to a respective said cross-member (24) by way of screws (26) passing through holes (27) formed in a first lateral wall (8) of an adjacent upright (5*a*, 5*b*) and rotatably coupleable with complementarily threaded holes (28) formed in an upper surface of the block (25).

3. The panel of claim 2, wherein said male element (32) is constituted by a plug which has an approximately T-shaped plan configuration, so as to form a first head (33) which has an approximately rectangular plan shape and has an approximately rectangular transverse cross-section and dimensions such as to allow to insert thereof partially within said first seat (6) of said uprights (5*a*, 5*b*).

4. The panel of claim 3, wherein said male element (32) has a first stem (36) having an approximately rectangular plan shape and beveled edges that protrudes from said first head (33) on the opposite side with respect to the respective one of said uprights (5*a*, 5*b*) in which the head (33) is inserted, said stem (36) protruding in use, axially and externally with respect to said respective one of said uprights (5*a*, 5*b*) in which said head (33) is inserted.

5. The panel of claim 4, wherein said female element (37) is constituted by a plug which has an approximately U-shaped plan configuration, so as to form a first base (38), which has an approximately rectangular plan shape, an approximately rectangular transverse cross-section and such dimensions that it can be accommodated, in use, in said first seat (6) provided in an upright (5*a*, 5*b*).

6. The panel of claim 5, wherein said female element has two first arms (41*a*, 41*b*) that protrude approximately at right angles from said base (38) on an opposite side with respect to said upright (5*a*, 5*b*) in whose first seat (6) the base (38) is accommodated, said arms (41*a*, 41*b*) being shaped approximately like a parallelepiped with beveled edges, a mutual distance between said two first arms (41*a*, 41*b*) being such that it is possible to accommodate therebetween, with a selected play, said first stem (36) of said male element (32), whereby said male (32) and female (37) elements allow two contiguous panels (1) arranged one above the other to perform axial movements and/or rotations.

7. The panel of claim 4, comprising a footing (43) which is suitable to support a first panel (1) arrangeable at a base of a building, said first stem (36) of said male element (32) coupled with a said upright (5*a*, 5*b*) being insertable in a complementarily shaped seat (42) having a substantially rectangular plan shape and formed at said footing (43), said third seat (42) having such dimensions as to allow said first stem (36) to be inserted axially therein and to perform a selected rotation with respect to a plane of arrangement thereof without escaping from said third seat (42).

8. The panel of claim 1, wherein said second seats (11) have an approximately T-shaped transverse cross-section, so as to form a first access port (12) and two first abutments (13) which extend along an entire length thereof.

9. The panel of claim 8, wherein said springs (44) are each constituted by a lamina which is extruded or folded so as to assume an approximately U-shaped plan configuration having an approximately flat base (45), whose dimensions are such that it can be accommodated in use within two of said second mutually facing second seats (11) of two mutually mated said uprights (5*a*, 5*b*).

10. The panel of claim 9, wherein said flat base (45) of said springs (44) is arrangeable, in use, within one of said second seats (11) adjacent to a second lateral wall (17) of a said upright (5*a*, 5*b*) and fixed thereto.

11. The panel of claim 10, wherein said springs comprise each two arms (47*a*, 47*b*) that protrude from said flat base (45), said arms (47*a*, 47*b*) being substantially flat and approximately mutually parallel and connected to said flat base (45) by means of an inclined portion which facilitates elastic flexing thereof in a direction of mutual approach.

12. The panel of claim 11, wherein said two arms (47*a*, 47*b*) have a length that is shorter than a sum of a distance formed by a space between two of mutually facing said second seats (11) of two mutually mated said uprights (5*a*, 5*b*).

13. The panel of claim 12, wherein free ends of said two arms (47*a*, 47*b*), are arranged, in use, approximately halfway along a depth of a respective said second seat (11), are folded toward outwards with respect to an inner part of said U-shaped configuration and toward said flat base (45), forming respectively two inclined hooks (48*a*, 48*b*) which can be arranged, in use, within said second seat (11) of an adjacent said upright (5*a*).

14. The panel of claim 13, wherein said hooks (48*a*, 48*b*) are suitable to engage, in use, respectively said two first abutments (13) formed in said second seats (11) so as to prevent escape thereof from said second seats (11) through said first access port (12).

15. The panel of claim 1, wherein said support (50) is shaped approximately like a parallelepiped, and said seats (51) have an approximately T-shaped transverse cross-section, so as to form an access port (52) and two second longitudinal abutments (53*a*, 53*b*), which extend along an entire length of said seats (51), openings (54) being further provided in said access port (52) for insertion therein of pins (55) suitable for fixing the support (55) to said load-bearing structure (49).

16. The panel of claim 15, wherein said at least one bracket (56) can be associated slidingly with said seats (51) and has an approximately T-shaped plan configuration so as to form said head (57), which is substantially shaped like a parallelepiped and can be slidingly coupled with a said seat (51).

17. The panel of claim 1, further comprising adjustment means (63) for adjusting an axial position of said brackets (56) with respect to said support (50).

18. The panel of claim 17, wherein said adjustment means are constituted by screws (63) and by perforated plates (64) suitable to abut against an upper transverse edge of said seats (51) in order to prevent escape of the heads (57) from the seats (51), a threaded stem of a said screw (63) being suitable to enter, through a said perforated plate (64), a complementarily threaded hole (58) formed in the head (57) of a said bracket (56).

* * * * *